United States Patent [19]

Barker et al.

[11] 3,958,916

[45] May 25, 1976

[54] DISTRIBUTOR PLATE

[75] Inventors: Michael Harris Barker, Ockley; Alan Gregson Roberts, Dorking, both of England

[73] Assignee: The British Coal Utilization Research Association Limited, Leatherhead, England

[22] Filed: Jan. 8, 1975

[21] Appl. No.: 539,592

[30] Foreign Application Priority Data

Jan. 10, 1974 United Kingdom ..... 1149/74

[52] U.S. Cl. ..... 431/170; 110/28 J; 431/278

[51] Int. Cl.[2] ..... F23D 19/00

[58] Field of Search ..... 431/170, 7, 328, 278; 110/28 J; 34/57 A

[56] References Cited

UNITED STATES PATENTS

| | | | |
|---|---|---|---|
| 2,408,282 | 9/1946 | Wolf | 431/170 X |
| 3,633,887 | 1/1972 | Bechthold | 431/170 X |
| 3,799,747 | 3/1974 | Schmalfeld et al. | 110/28 J |
| 3,881,857 | 5/1975 | Hoy et al. | 431/170 X |

*Primary Examiner*—Edward G. Favors
*Attorney, Agent, or Firm*—Morgan, Finnegan, Pine, Foley & Lee

[57] ABSTRACT

A fluidised bed distributor plate has a chamber having a fuel inlet with an air tube passing through the chamber. The interior of the air tube is in communication with the chamber and the upper end of the air tube is terminated in a head adapted to supply a combustible mixture of the fuel and air to the fluidised bed. The air tube has another surrounding tube having an air inlet and outlet. The air outlet is adapted to supply air to a region of the fluidised bed at a level below the fuel supply head.

8 Claims, 1 Drawing Figure

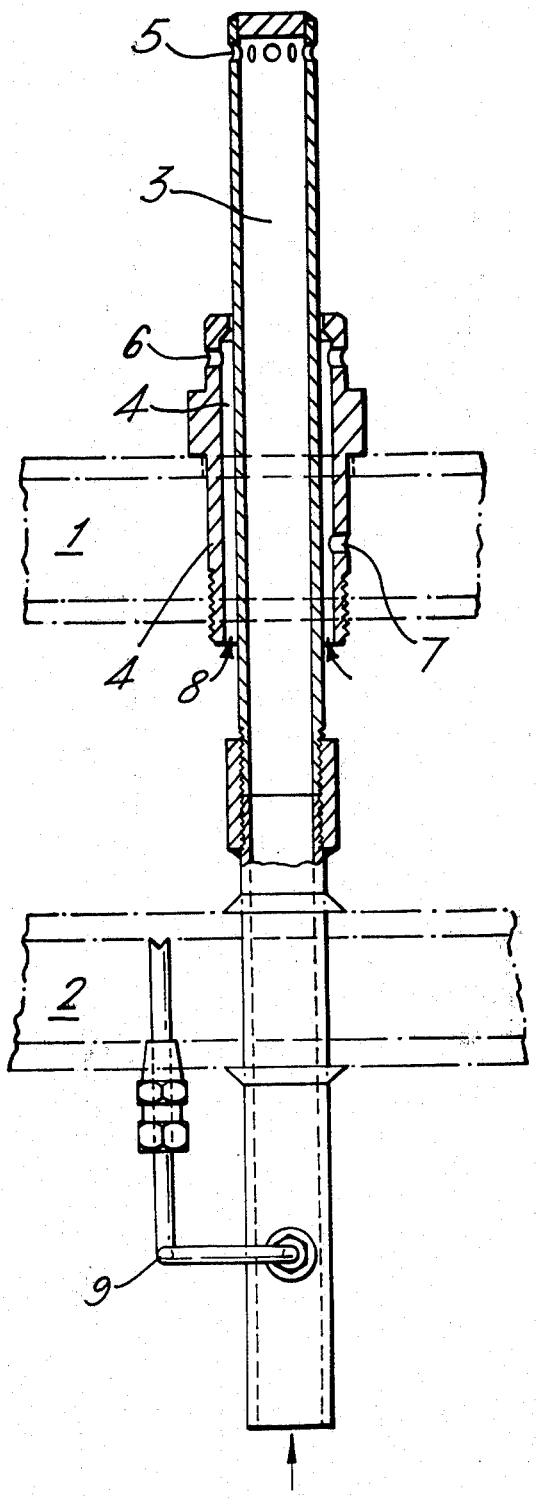
5
3
6
4
1
4
8
7
2
9

DISTRIBUTOR PLATE

This invention relates to a fluidised bed furnace.

A fluidised bed furnace is operated by blowing a combustible mixture of air and a fuel through a bed of a refractory particulate material to maintain the bed in a fluidised state. The fuel, which may be solid, liquid or gaseous, or a mixture, burns within the bed which is thereby maintained at an elevated temperature, e.g. in the range 700° – 1800°C.

Fluidised bed furnaces are capable of very high heat outputs and good heat transfer characteristics.

Difficulties, however, have sometimes been encountered in supplying liquid fuels, such as fuel oil to fluidised bed furnaces, since there is a tendency for supply nozzles to become blocked, and the combustion characteristics can be very sensitive to fuel distribution.

The distributor plate using a climbing film of fuel oil of our co-pending U.S. Pat. application Ser. No.324,401 filed 17th Jan., 1973 (hereinafter referred to as the parent specification) comprises a chamber fitted with fuel gas and oil inlets and a plurality of air tubes passing through said chamber, the interior of said air tubes being in communication with the chamber by means of holes and one end of the air tubes terminating in heads having outlets adapted to supply a combustible mixture to a fluidised bed furnace.

The parent specification thus describes a means for supplying liquid fuel to a fluidised bed which is less susceptible to blockage than some previous supply systems. It is desirable that (i) the fuel oil is injected into the fluidised bed with as much combustion air as possible and (ii) the fuel oil is only injected into a fully fluidised bed.

The present invention is a further development enabling more air to be available for combustion whilst still furnace, the bed communication terminating in a fluidised state below the fuel injection positions.

According to the present invention there provided a distributor plate suitable for use in a fluidised bed furnacce, said distributor plate comprising a chamber having a fuel inlet and an air tube passing through the chamber, the interior of the air tube being in communicatin with the chamber, one end of the air tube termminating in a head having outlets adapted to supply a combustible mixture including fuel and air to a fluidised bed furnace, there being a surrounding tube around the air tube, which surrounding tube has an air inlet and air outlet, the air outlet being adapted to supply air to a region of the fluidised bed beneath the head supplying the combustible mixture to the fluidised bed.

Preferably the shorter surrounding tube is connected to a supply of fuel gas. Most preferably there is a further chamber having a fuel gas inlet, which further chamber is in communication with the surrounding tube. Before the fluidised bed furnace is used for oil burning, it is started up by pre-heating the bed by combustion of fuel gas e.g. propane and air.

Preferably the distributor plate comprises a plurality of central air tubes and shorter surrounding tubes. Preferably a tube assembly density of 7–12 per square foot is used.

Preferably the total cross-sectional area of the outlets of the total tube heads is 1–4% of the total area of the plate.

Preferably the outlets of the outlet heads form passageways through the side of the central tube, the direction of the passageways being substantially perpendicular to the wall of the central tube.

Although the invention is primarily designed for liquid fuels, it can also be used as a distributor plate for use with solid fuels. In this case, the distributor plate acts simply as an air distributing system.

The fuel oil may be introduced into the fluidised bed by the climbing film technique described in our co-pending U.S. Pat. application Ser. No. 324,401 filed 17th Jan., 1973.

The dimensions of the air inlet and outlets of the outer surrounding tube or tubes are preferably adapted so that the proportion of air entering the central air tubes is 30 to 70% of the total air supply to the distributor plate.

The bed itself comprises mineral particles of a size range and bulk density appropriate to the velocity of the fluidising gas.

Suitable materials include broken refractory, sand, dolomite and limestone.

The distributor plate may also be used for gasification purposes. That is, the ratio of fuel/air supplied to the bed can be varied from sub-stoichiometric to excess air conditions. Thus the plate may be used to produce a low Btu fuel gas which may be consumed remote from the fluidised bed furnace.

The invention will now be described with reference to the accompanying drawing.

The DRAWING shows a partial vertical cross-section through a distributor plate according to the invention, the section showing a single concentric tube assembly.

The fluidised bed furnace comprises a plenum chamber, a distributor plate and a fluidised bed of sand of mesh size 10/30 mesh and bulk density of 80–100 pounds per cubic foot. The bed is situated within a 3 foot by 24 foot refractory-lined vessel.

The plate comprises a fuel gas chamber 1, and oil chamber 2 and a vertical assembly of two concentric tubes 3, 4. The inner 3 of the two tubes passes through the gas chamber 1 and oil chamber 2 and terminates in a head 5 adapted to supply a combustible mixture to a fluidised bed furnace. The shorter outer tube 4 passes through the fuel gas chamber 1 and terminates in a head 6 adapted to supply combustion air to the fluidised bed. (During start-up of the fluidised bed, the head 6 supplies a mixture of combustion air and fuel gas to the fluidised bed. The small holes 7 allow fuel gas from the gas chamber 1 to be entrained into the air tubes 4).

The air supply to the inner and outer tubes may be common or separate. About 50% of the fluidising air passes along the long inner tubes to yield a climbing film of oil and the rest enters the gap 8 between the inner 3 and outer tubes 4 and emerges from head 5 to give bed fluidisation.

The head 5 of the inner tube supplies oil to the fluidised bed and is of a shape designed to give good distribution and mixing of fuel and air. The particular design will be dependent upon the individual characteristics of the solid being fluidised and liquid fuel used.

Fuel oil is supplied to the interior of the inner tube 3 i.e., the inside wall of the tube 3 by means of a flow control device 9 in the form of lengths of tube. Other suitable flow control devices include weirs, orifices, or porous walled tubes.

During use of the furnace, the fluidised bed is preheated by means of a propane-air supply, the propane being supplied from the fuel gas chamber 1. After suitable bed operating conditions have been reached, the propane supply is gradually reduced and the oil feed supply switched in.

The oil introduced to the interior of the inner tube 3 by means of the flow control device 9 for example, a constant head device, is caused to pass up the tube 3 by a stream of air i.e. a climbing film of oil is formed in the tube.

The oil eventually reaches the outlet holes at the inner tube head 5 where it is entrained with air and is consumed in the fluidised bed.

The total cross-sectional area of the outlets of the tube heads is 1–4% of the total area of the plate.

The outlets of the tube heads 5 form passageways through the side of the air tube, the direction of the passageways being substantially perpendicular to the wall of the air tube 3.

We claim:

1. A distributor plate comprising a chamber having a fuel inlet and an air tube passing through the chamber, the interior of the air tube being in communication with the chamber, one end of the air tube terminating in a head having outlets adapted to supply a combustible mixture including fuel and air to a fluidised bed furnace, there being a surrounding tube around the air tube, which surrounding tube has an air inlet and air outlet, the air outlet being adapted to supply air to a region of the fluidised bed beneath the head supplying the combustible mixture to the fluidised bed.

2. A distributor plate according to claim 1 in which the surrounding tube is connected to a supply of fuel gas.

3. A distributor plate according to claim 2 in which the supply of fuel gas comprises a further chamber having a fuel gas inlet, the further chamber being in communication with the surrounding tube.

4. A distributor plate claim 1 which comprises a plurality of air tubes having surrounding tubes.

5. A distributor plate according to claim 4 in which the air tube density is from 7 to 12 per square foot.

6. A distributor plate according to claim 1 in which the total cross-sectional area of the outlets of the total tube heads is 1 to 4% of the total plate area.

7. A distributor plate according to claim 1 in which the dimensions of the air inlet and outlets of the outer surrounding tubes are adapted so that 30 to 70% of the total air supply to the distributor plate passes along the central air tubes.

8. A distributor plate according to claim 1 in which the outlets of the heads form passagesways through the side of the air tube, the direction of the passageways being substantially perpendicular to the wall of the central tube.

* * * * *

UNITED STATES PATENT OFFICE

CERTIFICATE OF CORRECTION

PATENT NO. : 3,958,916

DATED : May 25, 1976

INVENTOR(S) : Michael Harris Barker and Alan Gregson Roberts

It is certified that error appears in the above-identified patent and that said Letters Patent are hereby corrected as shown below:

Column 1, line 39, delete

"furnace, the bed communication terminating"

and add

--maintaining the bed--.

Signed and Sealed this

Third Day of August 1976

[SEAL]

*Attest:*

RUTH C. MASON
*Attesting Officer*

C. MARSHALL DANN
*Commissioner of Patents and Trademarks*